US005620037A

United States Patent [19]

Apostolo

[11] Patent Number: 5,620,037

[45] Date of Patent: Apr. 15, 1997

[54] MORTISED REMOVABLE STORM SHUTTER

[76] Inventor: Mauricio C. Apostolo, 5711 SW. 88th St., Miami, Fla. 33173

[21] Appl. No.: 438,106

[22] Filed: May 8, 1995

[51] Int. Cl.[6] ..... E06B 3/48; E04D 15/06

[52] U.S. Cl. ..... 160/118; 160/201; 160/202; 160/232; 52/202; 52/656.5; 49/50; 49/57

[58] Field of Search ..... 160/118, 119, 160/201, 202, 232, 172 R; 52/202, 203, 656.8, 656.7; 49/50, 61, 57

[56] References Cited

U.S. PATENT DOCUMENTS

| | | | |
|---|---|---|---|
| 2,916,089 | 12/1959 | D'Orazio | 160/201 |
| 3,516,470 | 6/1970 | Kurz | 160/35 |
| 3,853,169 | 12/1974 | Music et al. | 160/172 |
| 5,042,552 | 8/1991 | Prevatt | 160/118 |
| 5,138,745 | 8/1992 | Rentschler | 16/380 |
| 5,253,694 | 10/1993 | Bernardo | 160/133 |

*Primary Examiner*—Blair Johnson
*Assistant Examiner*—Bruce A. Lev
*Attorney, Agent, or Firm*—Richard L. Miller, P.E.

[57] ABSTRACT

A shutter device is provided for installation onto an exterior wall of a building over a window comprising a top bracket having a top longitudinal track therealong. A component is for mounting the top bracket horizontally above the window onto the exterior wall of the building, with the top longitudinal track facing downwardly. A bottom bracket is provided having a bottom longitudinal track therealong. Another component is for mounting the bottom bracket horizontally below the window onto the exterior wall of the building, with the bottom longitudinal track facing upwardly. A plurality of vertically extending barrier members are also provided. Element are provided for interlocking the barrier members together along their sides. A top slide assembly engages with the top ends of the barrier members, so that the top slide assembly can move across the top longitudinal track in the top bracket. A bottom slide assembly engages with the bottom ends of the barrier members. The bottom slide assembly can move across the bottom longitudinal track in the bottom bracket, enabling the interlocked barrier members to provide a complete protective barricade for the window when in place. An alternative version is also provided which can be utilized as a free standing fence.

11 Claims, 2 Drawing Sheets

MORTISED REMOVABLE STORM SHUTTER

BACKGROUND OF THE INVENTION

The instant invention relates generally to shutters and more specifically it relates to a mortised removable storm shutter.

Numerous shutters have been provided in prior art that are adapted to cover windows and doors in homes and buildings to increase privacy and add a degree of isolation from: violent storms, extreme heat and cold, burglars, intruders, etcetera. For example, U.S. Pat. Nos. 3,516,470 to Kurz; 3,853,169 to Music et al.; 5,042,552 to Prevatt; 5,138,745 to Rentschler and 5,253,694 to Bernardo all are illustrative of such prior art. While these units may be suitable for the particular purpose to which they address, they would not be as suitable for the purposes of the present invention as heretofore described.

SUMMARY OF THE INVENTION

A primary object of the present invention is to provide a mortised removable storm shutter that will overcome the shortcomings of the prior art devices.

Another object is to provide a mortised removable storm shutter, in which interlocking vertical rods are captured in upper and lower tracks of a window in a building, to create the storm shutter.

An additional object is to provide a mortised removable storm shutter, in which the upper and lower tracks are rails bolted to an exterior wall of the building, so that the interlocking vertical rods held therebetween will protect the window against flying objects during a hurricane or wind storm.

A further object is to provide a mortised removable storm shutter that is simple and easy to use.

A still further object is to provide a mortised removable storm shutter that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF THE PREFERRED EMBODIMENTS

Figure 1:
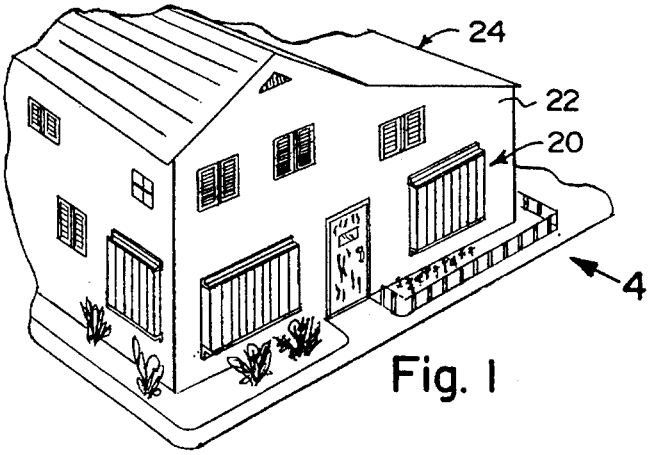
FIG. 1 is a diagrammatic perspective view illustrating an embodiment of the instant invention installed on a house.
Figure 2:
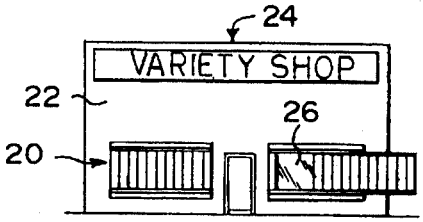
FIGS. 2 and 3 are diagrammatic elevational and perspective views illustrating embodiments of the instant invention installed on the windows of small buildings.
Figure 3:
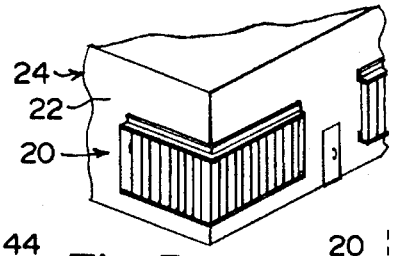
Figure 4:
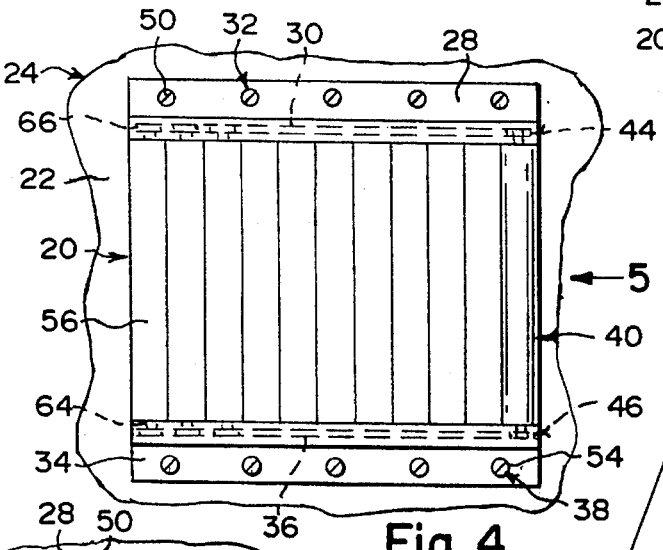
FIG. 4 is an enlarged elevational view taken in the direction of arrow 4 in FIG. 1, of a first embodiment of the instant invention.
Figure 5:
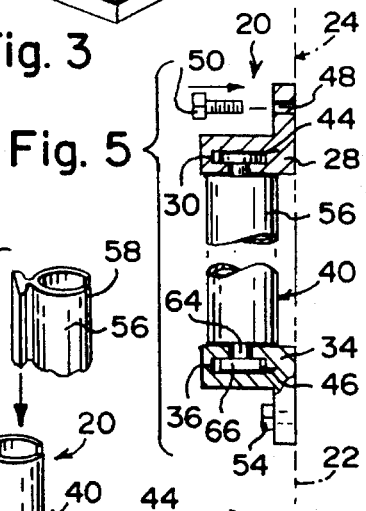
FIG. 5 is an enlarged side view partially sectioned with parts broken away taken in the direction of arrow 5 in FIG. 4.
Figure 6:
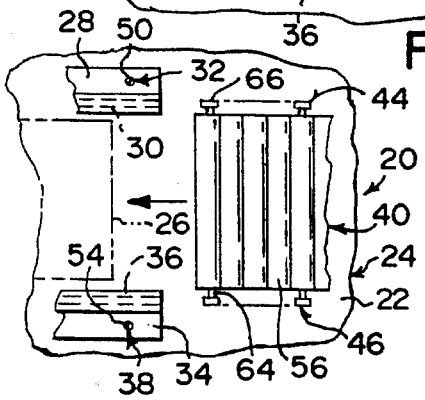
FIG. 6 is a diagrammatic elevational view of the first embodiment partially assembled.
Figure 7:
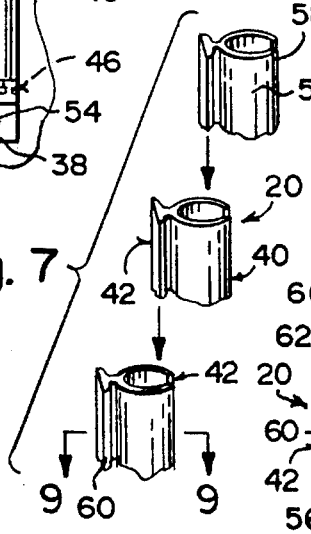
FIG. 7 is a diagrammatic exploded perspective view with parts broken away of some components.
Figure 8:
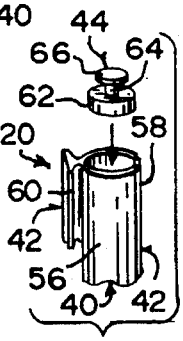
FIG. 8 is a diagrammatic exploded perspective view, showing the end plug assembly in greater detail.
Figure 9:
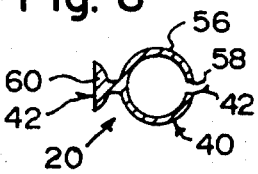
FIG. 9 is a cross sectional view taken on line 9—9 of FIG. 7.
Figure 10:
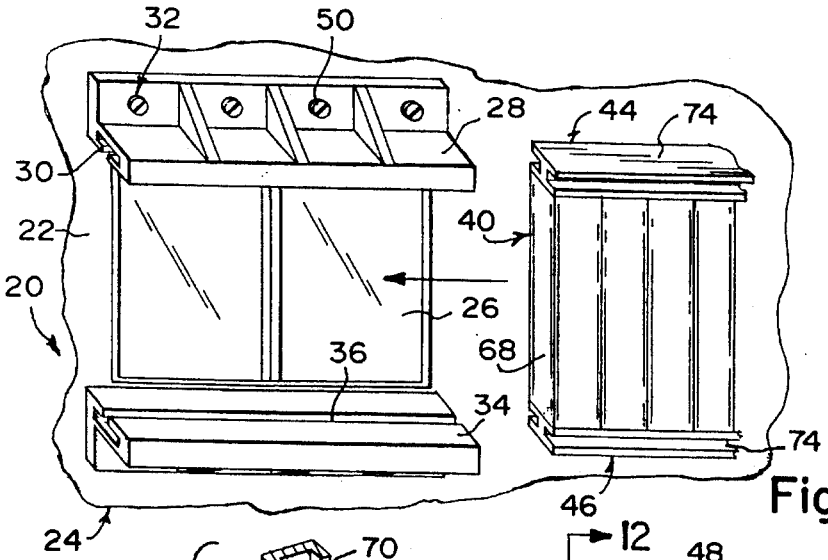
FIG. 10 is a diagrammatic perspective view of a second embodiment of the instant invention partially assembled.
Figure 12:
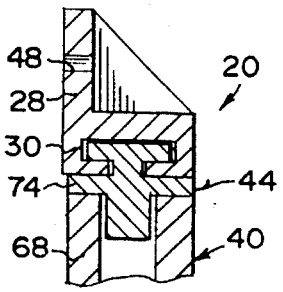
FIG. 12 is an enlarged cross sectional view with parts broken away taken on line 12—12 of FIG. 11.
Figure 13:
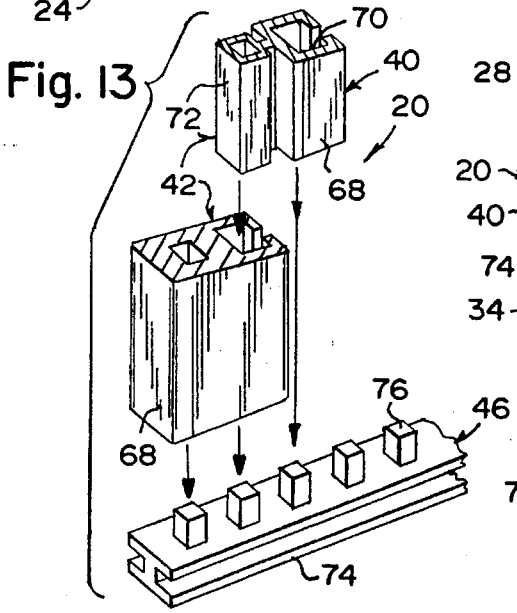
FIG. 13 is an enlarged diagrammatic exploded perspective view illustrating the interlocking mechanism with a channel top or bottom rail.
Figure 11:
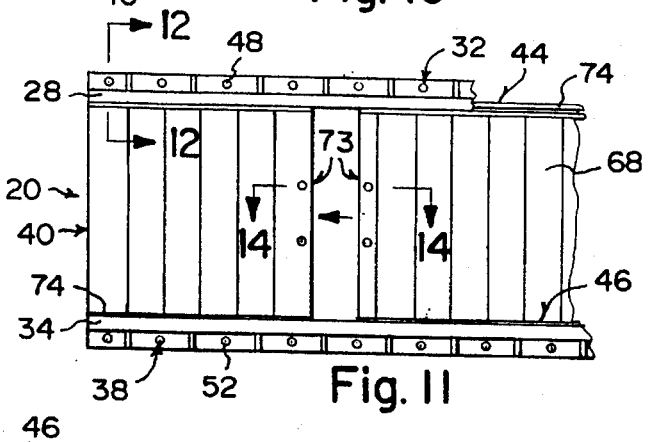
FIG. 11 is a diagrammatic elevational view of the second embodiment showing a center closure mechanism.
Figure 14:
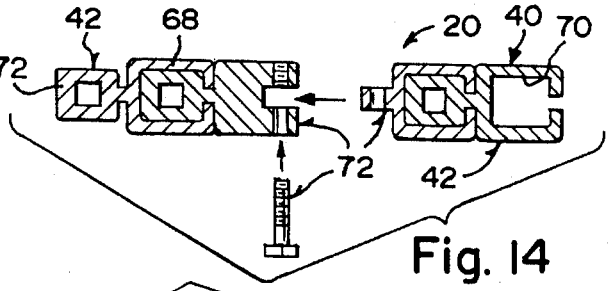
FIG. 14 is an enlarged cross sectional view taken on line 14—14 of FIG. 11.

Turning now descriptively to the drawings, in which similar reference characters denote similar elements throughout the several views, FIGS. 1 through 14 illustrate a mortised removable storm shutter 20 for installation onto an exterior wall 22 of a building 24 over a window 26, comprising a top bracket 28 having a top longitudinal track 30 therealong. A component 32 is for mounting the top bracket 28 horizontally above the window 26 onto the exterior wall 22 of the building 24, with the top longitudinal track 30 facing downwardly. A bottom bracket 34 is provided having a bottom longitudinal track 36 therealong. Another component 38 is for mounting the bottom bracket 34 horizontally below the window 26 onto the exterior wall 22 of the building 24, with the bottom longitudinal track 36 facing upwardly. A plurality of vertically extending barrier members 40 are also provided. Element 42 is for interlocking the barrier members 40 together along their sides. A top slide assembly 44 engages with the top ends of the barrier members 40, so that the top slide assembly 44 can move across the top longitudinal track 30 in the top bracket 28. A bottom slide assembly 46 engages with the bottom ends of the barrier members 40. The bottom slide assembly 46 can move across the bottom longitudinal track 36 in the bottom bracket 34, enabling the interlocked barrier members 40 to provide a complete protective barricade for the window 26 when in place.

The top bracket mounting component 32 consists of the top bracket 28 having a plurality of spaced apart holes 48 therealong above the top longitudinal track 30. A plurality of fasteners 50 are provided, in which each fastener 50 extends through one hole 48 in the top bracket 28 and into the exterior wall 22 of the building 24.

The bottom bracket mounting component 38 consists of the bottom bracket 34 having a plurality of spaced apart holes 52 therealong below the bottom longitudinal track 36. A plurality of fasteners 54 are provided, in which each fastener 54 extends through one hole 52 in the bottom bracket 34 and into the exterior wall 22 of the building 24.

Each barrier member 40, as shown in FIGS. 4 through 9, is an elongated tube 56. The interlocking element 42 includes each elongated tube 56 having a full length slot 58 on one side and a full length generally curved tab 60 on an opposite side. The tab 60 can slide through one slot 58 on a successive tube 56 and be retained thereto.

The top and bottom slide assemblies 44 and 46 each include a plurality of disk-shaped plugs 62, in which the plugs 62 fit into the top and bottom ends of the elongated tubes 56. A plurality of stems 64 are provided, in which each stem 64 extends outwardly from the center of each plug 62. A plurality of disk-shaped heads 66 are also provided. Each head 66 is affixed to each stem 64, to slide within the top and bottom longitudinal tracks 30 and 36 in the top and bottom brackets 28 and 34.

In FIGS. 10 through 14, the barrier member 40 is an elongated hollow modular unit 68. The interlocking element 42 includes each elongated modular unit 68 having a full length channel 70 on one side and a full length bar 72 on an opposite side. The bar 72 can slide through one channel 70 on a successive modular unit 68 and be retained thereto.

A center closure mechanism 73 is between a right side set of interlocked modular units 68 and a left side set of interlocked modular units 68. The top and bottom slide assemblies 44 and 46 each include a generally I-shaped rail 74, having a plurality of upstanding spaced apart rectangular shaped plugs 76. The plugs 76 fit into the top and bottom ends of the modular units 68. The rails 74 can slide within the top and bottom longitudinal tracks 30 and 36 in the top and bottom brackets 28 and 34.

Figure 16:
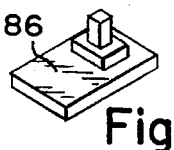
FIG. 16 is a perspective view taken generally in the area of arrow 16 of FIG. 15, showing a first end support therefore.
Figure 16A:
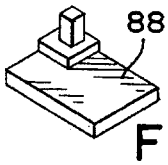
FIG. 16A is a perspective view taken generally in the area of arrow 16A of FIG. 15 showing a second end support therefore.
Figure 17:
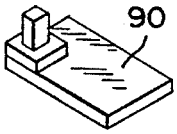
FIG. 17 is a perspective view taken generally in the area of arrow 17 of FIG. 15, showing a corner support therefore.
Figure 18:
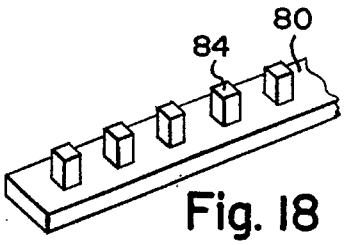
FIG. 18 is an enlarged diagrammatic perspective view with parts broken away illustrating a typical bottom or top rail therefore.
Figure 15:
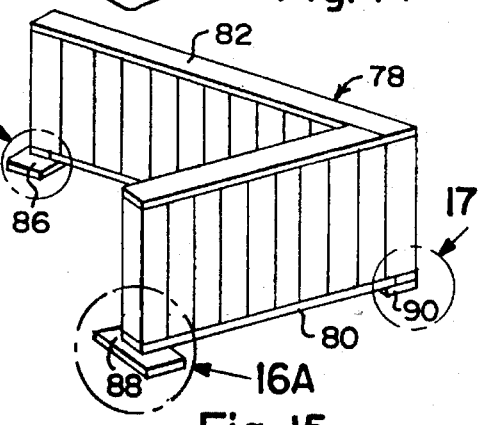
FIG. 15 is a diagrammatic perspective view illustrating a third embodiment of the instant invention being a free-standing partition or fence.

In FIG. 15, an embodiment of the shutter 20 is illustrated being utilized as a free-standing partition or fence 78. Bottom and top rails 80 and 82 are provided, with upstanding spaced apart rectangular shaped plugs 84, as shown in FIG. 18. First and second end supports 86 and 88, as best seen in FIGS. 16 and 16A are utilized. A corner support 90, best seen in FIG. 17, is also utilized to stabilize and support the free-standing partition or fence 78 in an upright position.

OPERATION OF THE INVENTION

To use the mortised removable storm shutter 20, a person simply mounts the top bracket 28 and the bottom bracket 34 above and below the window 26 on the exterior wall 22 of the building 24 with fasteners 50 and 54. The top longitudinal track 30 is facing downwardly and the bottom longitudinal track 36 is facing upwardly. The barrier members 40 are then interlocked together with the top slide assembly 44 and the bottom slide 9 assembly 46 attached to the barrier members 40. The top slide assembly 44 will move across the top longitudinal track 30, and the bottom slide assembly 46 will also move across the bottom longitudinal track 36, to provide the interlocked barrier members 40 as a complete protective barricade for the window 26 during a hurricane or wind storm.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

The invention claimed is:

1. A mortised removable storm shutter for installation onto an exterior wall of a building over a window comprising:

a) an elongated, substantially L-shaped, and horizontally-disposed top bracket having a pair of ends; said elongated, substantially L-shaped, and horizontally-disposed top bracket further having an elongated vertical portion with a lower edge and a plurality of longitudinally-disposed and spaced-apart throughbores extending longitudinally therealong; said elongated vertical portion of said elongated, substantially L-shaped, and horizontally-disposed top bracket being mountable horizontally above the window onto the exterior wall of the building; said elongated, substantially L-shaped, and horizontally-disposed top bracket further having an elongated horizontal portion extending normally outwardly from said lower edge of said elongated vertical portion of said elongated, substantially L-shaped, and horizontally-disposed top bracket; said elongated horizontal portion of said elongated, substantially L-shaped, and horizontally-disposed top bracket having a lower surface with a longitudinally-disposed and substantially T-shaped track extending therealong from one end of said pair of ends of said elongated, substantially L-shaped, and horizontally-disposed top bracket to another end of said pair of ends of said elongated, substantially L-shaped, and horizontally-disposed top bracket;

b) means for mounting said elongated vertical portion of said elongated, substantially L-shaped, and horizontally-disposed top bracket horizontally above the window onto the exterior wall of the building with said longitudinally-disposed and substantially T-shaped track of said lower surface of said elongated horizontal portion of said elongated, substantially L-shaped, and horizontally-disposed top bracket facing downwardly;

c) an elongated, substantially L-shaped, and horizontally-disposed bottom bracket having a pair of ends; said elongated, substantially L-shaped, and horizontally-disposed bottom bracket further having an elongated vertical portion with an upper edge and a plurality of longitudinally-disposed and spaced-apart throughbores extending longitudinally therealong; said elongated vertical portion of said elongated, substantially L-shaped, and horizontally-disposed bottom bracket being mountable horizontally below the window onto the exterior wall of the building; said elongated, substantially L-shaped, and horizontally-disposed bottom bracket further having an elongated horizontal portion extending normally outwardly from said upper edge of said elongated vertical portion of said elongated, substantially L-shaped, and horizontally-disposed bottom bracket; said elongated horizontal portion of said elongated, substantially L-shaped, and horizontally-disposed bottom bracket having an upper surface with a longitudinally-disposed and substantially T-shaped track extending therealong from one end of said pair of ends of said elongated, substantially L-shaped, and horizontally-disposed bottom bracket to another end of said pair of ends of said elongated, substantially L-shaped, and horizontally-disposed bottom bracket;

d) means for mounting said elongated vertical portion of said elongated, substantially L-shaped, and horizontally-disposed bottom bracket horizontally below the window onto the exterior wall of the building with said longitudinally-disposed and substantially T-shaped track of said upper surface of said elongated horizontal portion of said elongated, substantially L-shaped, and horizontally-disposed bottom bracket facing upwardly;

e) a plurality of interlocked and vertically extending barrier members; each member of said plurality of interlocked and vertically extending barrier members having sides, a top end, and a bottom end and being non-pivotally interlocked with each other so as to form a rigid barrier;

f) means for non-pivotally interlocking one side of said sides of one member of said plurality of interlocked and vertically extending barrier members to one side of said sides of an adjacent member of said plurality of interlocked and vertically extending barrier members said means comprising complimentary interlocking elements on respective sides of each barrier member;

g) a top slide assembly engaging said top end of each member of said plurality of interlocked and vertically extending barrier members, so that said top slide assembly can slide across said longitudinally-disposed and substantially T-shaped track in said lower surface of said elongated horizontal portion of said elongated, substantially L-shaped, and horizontally-disposed top bracket; and h) a bottom slide assembly engaging said bottom end of each member of said plurality of interlocked and vertically extending barrier members, so that said bottom slide assembly can slide across said longitudinally-disposed and substantially T-shaped track in said upper surface of said elongated horizontal portion of said elongated, substantially L-shaped, and horizontally-disposed bottom bracket, so that said rigid and non-pivoting barrier formed by said plurality of interlocked and vertically extending barrier members can slide in said top and bottom elongated, substantially L-shaped, and horizontally-disposed bottom brackets and provide a complete protective barricade for the window when in place and slide out of said top and bottom elongated, substantially L-shaped, and horizontally-disposed bottom brackets when not in use and be dissembled for storage.

2. The mortised removable storm shutter as recited in claim 1, wherein said top bracket mounting means includes a plurality of fasteners; each fastener of said plurality of fasteners of said top bracket mounting means extends through a respective throughbore of said plurality of longitudinally-disposed and spaced-apart throughbores of said vertical portion of said elongated, substantially L-shaped, and horizontally-disposed top bracket and into the exterior wall of the building.

3. The mortised removable storm shutter as recited in claim 1, wherein said bottom bracket mounting means includes a plurality of fasteners; each fastener of said plurality of fasteners of said bottom bracket mounting means extends through respective throughbore of said plurality of longitudinally-disposed and spaced-apart throughbores of said vertical portion of said elongated, substantially L-shaped, and horizontally-disposed bottom bracket and into the exterior wall of the building.

4. The mortised removable storm shutter as recited in claim 1, wherein each member of said plurality of interlocked and vertically extending barrier members is an elongated, hollow, and cylindrically-shaped tube.

5. The mortised removable storm shutter as recited in claim 4, wherein said interlocking means includes each said elongated, hollow, and cylindrically-shaped tube having a full length and longitudinally-disposed throughslot on one side thereof and a full length substantially T-shaped tab on an opposite side thereof, so that said full length substantially T-shaped tab of one said elongated, hollow, and cylindrically-shaped tube can slide through said full length and longitudinally-disposed throughslot on a successive said elongated, hollow, and cylindrically-shaped tube and be rigidly retained thereto.

6. The mortised removable storm shutter as recited in claim 4, wherein said top and bottom slide assemblies each include:

a) a plurality of cylindrically-shaped plugs; each plug of said plurality of cylindrically-shaped plugs has a diameter and a center and fits into said top and bottom ends of each said elongated, hollow, and cylindrically-shaped tube;

b) a plurality of elongated, slender, and cylindrically, shaped stems; each stem of said plurality of elongated, slender, and cylindrically-shaped stems has a diameter less than said diameter of each plug of said plurality of cylindrically-shaped plugs and extends outwardly from said center of a respective plug of said plurality of cylindrically-shaped plugs; and c) a plurality of disk-shaped heads; each head of said plurality of disk-shaped heads has a diameter greater than said diameter of each stem of said plurality of elongated, slender, and cylindrically-shaped stems and less than said diameter of each plug of said plurality of cylindrically-shaped plugs and is affixed to a respective stem of said plurality of elongated, slender, and cylindrically-shaped to slide within said top and bottom longitudinally-disposed and substantially T-shaped tracks in said top and bottom elongated, substantially L-shaped, and horizontally-disposed brackets.

7. The mortised removable storm shutter as recited in claim 1, wherein each of said plurality of interlocked and vertically extending barrier members is an elongated, hollow, and rectangular-parallelepiped-shaped modular unit.

8. The mortised removable storm shutter as recited in claim 7, wherein said interlocking means includes each said elongated, hollow, and rectangular-parallelepiped-shaped modular unit having a full length, longitudinally-disposed, and substantially T-shaped throughchannel on one side thereof and a full length, hollow, and substantially T-shaped bar on an opposite side thereof, so that said full length, hollow, and substantially T-shaped bar of one said elongated, hollow, and rectangular-parallelepiped-shaped modular unit can slide through said full length, longitudinally-disposed, and substantially T-shaped throughchannel on a successive said elongated, hollow, and rectangular-parallelepiped-shaped modular unit and be rigidly retained thereto.

9. The mortised removable storm shutter as recited in claim 8, further including a center closure mechanism for securing a right side set of interlocked elongated, hollow, and rectangular-parallelepiped-shaped modular units and a left side set of interlocked elongated, hollow, and rectangular-parallelepiped-shaped modular units; said center closure mechanism includes a bolt that threadably engages a threaded and laterally-disposed throughbore in said right side set of interlocked elongated, hollow, and rectangular-parallelepiped-shaped modular units and said left side set of interlocked elongated, hollow, and rectangular-parallelepiped-shaped modular units.

10. The mortised removable storm shutter as recited in claim 7, wherein said top and bottom slide assemblies each include a single generally I-shaped rail having a plurality of upstanding, spaced-apart, and rectangular-parallelepiped-shaped plugs; each plug of said plurality of upstanding, spaced-apart, and rectangular-parallelepiped-shaped plugs fits into said top and bottom ends of a respective said elongated, hollow, and rectangular-parallelepiped-shaped modular unit, so that each rail of said single generally I-shaped rail can slide within a respective track of said top and bottom substantially T-shaped tracks in said top and bottom elongated, substantially L-shaped, and horizontally-disposed brackets.

11. A method of protecting a window comprising the step of installing onto an exterior wall of a building over the window a mortised removable storm shutter which comprises:

a) an elongated, substantially L-shaped, and horizontally-disposed top bracket having a pair of ends; said elongated, substantially L-shaped, and horizontally-disposed top bracket further having an elongated vertical portion with a lower edge and a plurality of longitudinally-disposed and spaced-apart throughbores extending longitudinally therealong; said elongated vertical portion of said elongated, substantially L-shaped, and horizontally-disposed top bracket being mountable horizontally above the window onto the exterior wall of the building; said elongated, substantially L-shaped, and horizontally-disposed top bracket further having an elongated horizontal portion extending normally outwardly from said lower edge of said elongated vertical portion of said elongated, substantially L-shaped, and horizontally-disposed top bracket; said elongated horizontal portion of said elongated, substantially L-shaped, and horizontally-disposed top bracket having a lower surface with a longitudinally-disposed and substantially T-shaped track extending therealong from one end of said pair of ends of said elongated, substantially L-shaped, and horizontally-disposed top bracket to another end of said pair of ends of said elongated, substantially L-shaped, and horizontally-disposed top bracket;

b) means for mounting said elongated vertical portion of said elongated, substantially L-shaped, and horizontally-disposed top bracket horizontally above the window onto the exterior wall of the building with said longitudinally-disposed and substantially T-shaped track of said lower surface of said elongated horizontal portion of said elongated, substantially L-shaped, and horizontally-disposed top bracket facing downwardly;

c) an elongated, substantially L-shaped, and horizontally-disposed bottom bracket having a pair of ends; said elongated, substantially L-shaped, and horizontally-disposed bottom bracket further having an elongated vertical portion with an upper edge and a plurality of longitudinally-disposed and spaced-apart throughbores extending longitudinally therealong; said elongated vertical portion of said elongated, substantially L-shaped, and horizontally-disposed bottom bracket being mountable horizontally below the window onto the exterior wall of the building; said elongated, substantially L-shaped, and horizontally-disposed bottom bracket further having an elongated horizontal portion extending normally outwardly from said upper edge of said elongated vertical portion of said elongated, substantially L-shaped, and horizontally-disposed bottom bracket; said elongated horizontal portion of said elongated, substantially L-shaped, and horizontally-disposed bottom bracket having an upper surface with a longitudinally-disposed and substantially T-shaped track extending therealong from one end of said pair of ends of said elongated, substantially L-shaped, and horizontally-disposed bottom bracket to another end of said pair of ends of said elongated, substantially L-shaped, and horizontally-disposed bottom bracket;

d) means for mounting said elongated vertical portion of said elongated, substantially L-shaped, and horizontally-disposed bottom bracket horizontally below the window onto the exterior wall of the building with said longitudinally-disposed and substantially T-shaped track of said upper surface of said elongated horizontal portion of said elongated, substantially L-shaped, and horizontally-disposed bottom bracket facing upwardly;

e) a plurality of interlocked and vertically extending barrier members; each member of said plurality of interlocked and vertically extending barrier members having sides, a top end, and a bottom end and being non-pivotally interlocked with each other so as to form a rigid barrier;

f) means for non-pivotally interlocking one side of said sides of one member of said plurality of interlocked and vertically extending barrier members to one side of said sides of an adjacent member of said plurality of interlocked and vertically extending barrier members said means comprising complimentary interlocking elements on respective sides of each barrier member;

g) a top slide assembly engaging said top end of each member of said plurality of interlocked and vertically extending barrier members, so that said top slide assembly can slide across said longitudinally-disposed and substantially T-shaped track in said lower surface of said elongated horizontal portion of said elongated, substantially L-shaped, and horizontally-disposed top bracket; and h) a bottom slide assembly engaging said bottom end of each member of said plurality of interlocked and vertically extending barrier members, so that said bottom slide assembly can slide across said longitudinally-disposed and substantially T-shaped track in said upper surface of said elongated horizontal portion of said elongated, substantially L-shaped, and horizontally-disposed bottom bracket, so that said rigid and non-pivoting barrier formed by said plurality of interlocked and vertically extending barrier members can slide in said top and bottom elongated, substantially L-shaped, and horizontally-disposed bottom brackets and provide a complete protective barricade for the window when in place and slide out of said top and bottom elongated, substantially L-shaped, and horizontally-disposed bottom brackets when not in use and be dissembled for storage.

* * * * *